United States Patent [19]

Akashi

[11] 3,991,447

[45] Nov. 16, 1976

[54] SLIDER FOR SLIDING CLASP FASTENER

[75] Inventor: Shunji Akashi, Kurobe, Japan

[73] Assignee: Yoshida Kogyo Kabushiki Kaisha, Japan

[22] Filed: July 8, 1975

[21] Appl. No.: 594,023

[30] Foreign Application Priority Data

July 17, 1974 Japan ..... 49-82005

[52] U.S. Cl. ..... 24/205.14 R

[51] Int. Cl.[2] ..... A44B 19/30

[58] Field of Search ..... 24/205.14 R

[56] References Cited

UNITED STATES PATENTS

| | | | |
|---|---|---|---|
| 2,172,217 | 9/1939 | Morin | 24/205.14 R |
| 2,189,727 | 2/1940 | Corner | 24/205.14 R |
| 2,274,723 | 3/1942 | Morin | 24/205.14 R |
| 2,289,585 | 7/1942 | Marinsky | 24/205.14 R |
| 2,301,792 | 12/1942 | Plumley | 24/205.14 R |
| 2,502,055 | 3/1950 | Marinsky | 24/205.14 R |
| 2,512,213 | 6/1950 | Morin | 24/205.14 R |

FOREIGN PATENTS OR APPLICATIONS

| | | | |
|---|---|---|---|
| 417,781 | 10/1934 | United Kingdom | 24/205.14 R |

*Primary Examiner*—Bernard A. Gelak
*Attorney, Agent, or Firm*—Bucknam and Archer

[57] ABSTRACT

A slider for a sliding clasp fastener is assembled essentially with a slider body, a pull tab, a cap-like yoke and/or means of locking the slider. The yoke has its lower longitudinal edges fitted into grooves or indents formed in the slider body, and inter-fitting portions are fused together as by an ultrasonic processing into an integral joint.

2 Claims, 5 Drawing Figures

SLIDER FOR SLIDING CLASP FASTENER

BACKGROUND OF THE INVENTION

This invention relates to sliders for sliding clasp fasteners, more particularly to such a slider which essentially comprises a slider body, a pull tab, a yoke and/or a locking spring member housed in the yoke.

In the assembling of these slider components there are known two typical methods of attaching the yoke to the slider body. One such method consisted in bringing the yoke into snapping engagement with a bail or lug projecting upwardly from the slider body. The other method was to rivet the front and back end walls and/or the side walls of the yoke into the bail. The first mentioned method of slider assembly suffered from the drawback that the yoke is susceptible to disengagement from the slider body. The rivetting operation in the second mentioned method was rather time-consuming and tedious and often involved off-specification products due to machining errors.

SUMMARY OF THE INVENTION

With the foregoing deficiencies of the prior art sliders in view, the present invention is aimed at the provision of a slider which can be assembled with maximum ease and minimum machining errors.

Another aim of the invention is to provide an improved slider which is reliable and durable in service, with its caplike yoke firmly secured to the slider body.

Briefly stated, there is provided a slider for a sliding clasp fastener according to the invention, which slider essentially comprises a slider body, a pull tab, a yoke and/or a locking spring member, the yoke being deposited by fusion into position on the slider body by means of an ultrasonic or other suitable deposition processing.

The invention will be better understood from the following detailed description taken in connection with the accompanying drawing which illustrates by way of example some preferred embodiments which the invention assumes in practice.

DETAILED DESCRIPTION OF THE PREFERRED EMBODIMENTS

Figure 1:
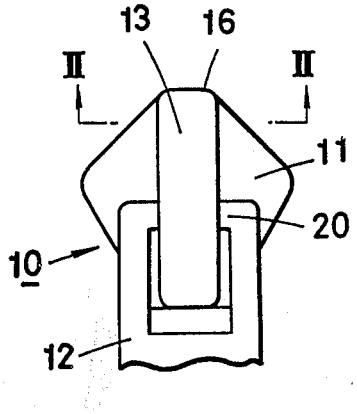
FIG. 1 is a top plan view of a slider provided in accordance with the invention.
Figure 2:
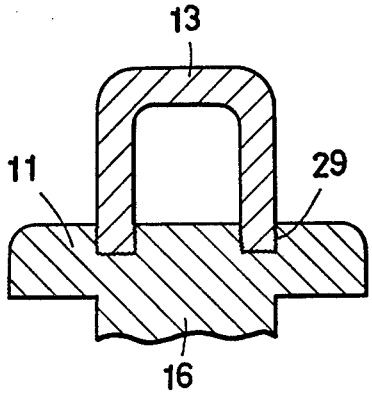
FIG. 2 is a transverse cross-sectional view taken along the line II—II of FIG. 1.
Figure 3:
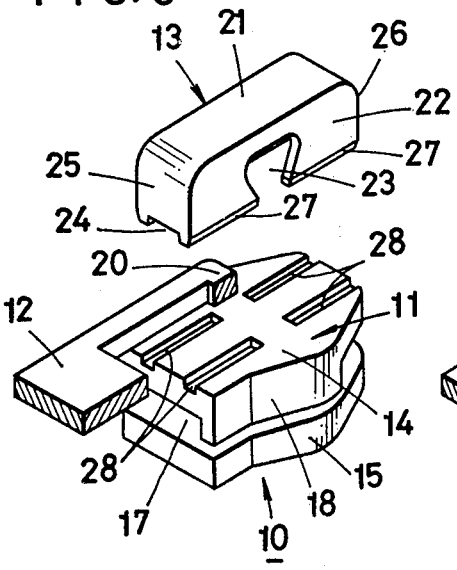
FIG. 3 is an exploded view of the slider of FIG. 1.

Referring now to the drawing and FIGS. 1 to 3 in particular, there is shown a slider of the non-locking type generally designated 10 and essentially comprising a slider body 11, a pull tab 12 and a yoke 13. The slider body 11 is constituted by an upper shield 14 and a lower shield 15 connected together at one end and in spaced opposed relation by an integral neck portion 16 to provide a substantially Y-shaped channel 17 therebetween for the passage of rows of fastener elements (not shown). Flanges 18 extend inwardly from the upper shield 14 and serve to retain the fastener elements in the Y-shaped channel 17 during longitudinal movement of the slider 10 along the rows of interlocking elements of a sliding clasp fastener (not shown) to open or close the latter in the well known manner.

The pull tab 12 generally rectangular in shape is centrally apertured to provide at one end a transversely extending pintle 20 which serves as a pivotal axis for the pivotal movement of the pull tab.

The yoke 13 has the shape of an elongated hollow cap and has an upper portion 21 and two side walls 22 depending therefrom. Each side wall 22 is provided at or near its center a recess 23 extending upwards from the lower edge of the respective side wall. The recess 23 is utilized for hinging the pull tab 12 at the pintle 20 to the yoke 13.

There is formed a cut-away recess 24 in each of the front and back end walls 25, 26 of the yoke 13 so as to provide four symmetric flanges 27 at the lower edges of the two side walls 22.

The upper shield 14 has formed in its upper surface a plurality of elongated grooves 28 adapted to receive the flanged lower edges 27 of the yoke 13. More specifically, there are provided in the presently shown embodiment such grooves which are transversely separated into two pairs of grooves or indents 28 extending longitudinally of the slider body 11 and in spaced parallel relation with each other and dimensioned to fit with the flanges 27 of the yoke 13, as best shown in FIG. 3.

In the assembly of the component members of the nonlocking slider just described, the cap-like yoke 13 is mounted on the slider body 11 with the flanged lower edges 27 of the yoke inserted into the corresponding grooves 28 of the upper shield 14 and with the pull tab 12 interposed between the yoke 13 and the upper shield 14. Importantly in accordance with the invention, an ultrasonic or similar deposition treatment is applied to the flange-and-groove connections 29 of the yoke 13 and the upper shield 14 so that the material of these members melts and deposits one on the other to form an integral joint. In such instance the provision of the grooves 28 prevents molten material from flowing out and scattering around on the slider body, which would otherwise make the finished slider look unattractive. Another advantage of the provision of the grooves 28 is that the yoke 13 can be guided into the proper position on the slider body by registering the flanged edges 27 of the yoke 13 with the grooves 28. This can greatly facilitate the assembling operation especially where such operation is automatically performed. If the material of the slider 10 is a synthetic resin such as nylon or tetron, it is preferred to reinforce the same with a glass fiber or similar fibrous material so that the finished slider has sufficient hardness and strength, particularly where the connections between the yoke and the upper shield are fused together by a remotely located ultrasonic hone as in the so-called "conductive deposition". A choice of synthetic materials for the slider 10 is advantageous in that the slider can be dyed simultaneously with the dyeing of a finished sliding clasp fastener. Where the slider 10 is made of a metal, the yoke to shield connections may be finished by electric-resistance welding or high-frequency welding.

Figure 4:
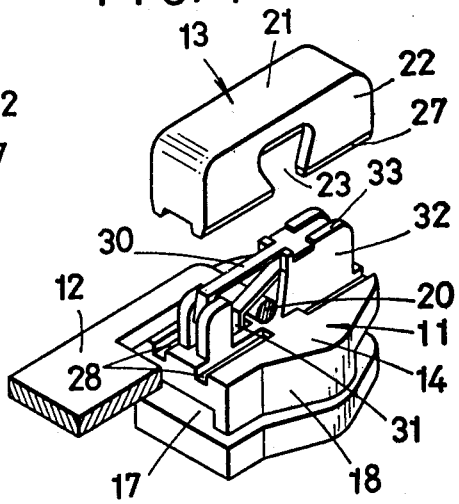
FIG. 4 is an exploded view of another slider embodying the invention.
Figure 5:
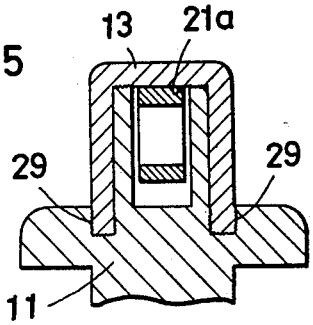
FIG. 5 is a transverse cross-sectional view of the slider of FIG. 4 taken when the same has been assembled.

Reference now to FIGS. 4 and 5 shows a slider of the automatically locking type, that is to say, the slider includes means for automatically locking it in position on the sliding clasp fastener to prevent unintentional movement of the slider. This locking means consists of a spring member 30 having at one end a prong 31 movable into and out of engagement with the fastener elements and connected at the other end to a bifurcated bail or lug 32 projecting upwardly from the slider body 11.

Other structural details of this locking slider are substantially similar to those of the non-locking slider previously described. The yoke 13 is joined to the slider body 11 by fitting the flanged lower edges 27 of the yoke into the grooves 28 of the upper shield 14, and subjecting there connecting portions to ultrasonic or other deposition processing as already stated.

In the embodiment shown in FIGS. 4 and 5, the dimensions of the yoke 13 are determined such that the inner wall 21*a* of its upper portion 21 lies substantially in abutting relation to the upper surfaces 33 of the bail 32 when the yoke 13 is mounted in position on the upper shield 14. Deposition processing may be also applied to the connections between the inner wall 21*a* of the yoke and the upper surfaces 33 of the upper shield 14 thereby intensifying the joint of the yoke 13 to the slider body 11.

While the invention has been described with reference to certain preferred embodiments, it will be understood the invention is not to be limited to the precise form and construction herein advanced but various changes and modifications may be made therein without departing from the scope of the appended claims. As for an example, the flanged lower edges 27 of the yoke 13 may be tapered so that they can be received more easily into the corresponding grooves 28 of the upper shield 14.

What is claimed is:

1. In a slider for a sliding clasp fastener having a slider body with an upper shield and a lower shield, a pull tab, and a yoke, the improvement which comprises the yoke having an upper portion and a pair of opposed side walls depending from said upper portion, each of said side walls having a generally uniform thickness down to a lower edge, and the upper shield of the slider body having a plurality of elongated longitudinally extending grooves directed upwardly out of the surface of said upper shield with each disposed to receive a corresponding lower edge of said side walls, said lower edges and upper shield being integrally fused together at said grooves to connect said yoke to the upper shield of the slider body.

2. The improvement according to claim 1 including a bail extending from said upper shield into abutting contact with the inside surface of the upper portion of the yoke and integrally fused thereto.

* * * * *